US006336634B1

(12) United States Patent
Stott

(10) Patent No.: US 6,336,634 B1
(45) Date of Patent: Jan. 8, 2002

(54) BOARD GAME

(76) Inventor: Brian Stott, 3 Alma Ave, Foulridge, Colne Lancashire BB8 7NS (GB)

( * ) Notice: Subject to any disclaimer, the term of this patent is extended or adjusted under 35 U.S.C. 154(b) by 0 days.

(21) Appl. No.: 09/747,878

(22) Filed: Dec. 26, 2000

(51) Int. Cl.[7] ..... A63F 3/00

(52) U.S. Cl. ..... 273/287; 273/243; 273/249; 273/280; 273/283

(58) Field of Search ..... 273/236, 241, 273/243, 248, 249, 280, 281, 283, 284, 287

(56) References Cited

U.S. PATENT DOCUMENTS 3,888,490 A * 6/1975 Kline
4,157,184 A 6/1979 Recard, Jr.
4,188,034 A * 2/1980 Dempsey
4,221,387 A 9/1980 Carter
4,223,892 A * 9/1980 Matherne
4,270,754 A * 6/1981 Imatt
4,813,678 A 3/1989 Collazo et al.
D306,322 S 2/1990 Kropfl
4,998,735 A * 3/1991 Blackwell
5,083,793 A * 1/1992 Sanford
5,356,153 A * 10/1994 Morse
5,678,820 A 10/1997 Miller
5,709,384 A * 1/1998 Miller
5,839,729 A 11/1998 Watanabe
5,931,470 A * 8/1999 Smith

FOREIGN PATENT DOCUMENTS

FR 2551987 A1 * 12/1985

* cited by examiner

*Primary Examiner*—Benjamin H. Layno
*Assistant Examiner*—Vishu K Mendiratta

(57) ABSTRACT

A board game for providing entertainment and teaching strategy. The board game includes a game board having plurality of discrete paths thereon and defining a quadrant. Each of the game paths is divided into a plurality of game spaces and each game path ends at an inner circle position in a central portion of the game board. Each of the game spaces is colored a color selected from the group consisting of green, orange, blue, red, yellow, brown and white. Each of a plurality of overlays is positionable on one of the game paths. Each of the overlays generally has the shape of one of the game paths such that each of the overlays may be positioned over one of the quadrants. Each of the overlays is substantially transparent. Each of the overlays has a plurality of symbols thereon. A first die is a six sided die, wherein each of the sides has a different indicia thereon indicating a number 1 through 6. A second die is a six sided die, wherein each of the sides has a different color indicia thereon indicating green, orange, blue, red, yellow or brown. A third die is a six sided die, wherein each of the sides of the third die has a different symbol indicia thereon indicating one of the symbols on the overlays.

6 Claims, 3 Drawing Sheets

BOARD GAME

BACKGROUND OF THE INVENTION

1. Field of the Invention

The present invention relates to board games and more particularly pertains to a new board game for providing entertainment and teaching strategy.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,839,729; U.S. Pat. No. 4,813,678; U.S. Des. Pat. No. 306,322; U.S. Pat. No. 4,221,387; U.S. Pat. No. 4,157,184; U.S. Pat. No. 5,678,820.

While these devices fulfill their respective, particular objectives and requirements, the aforementioned patents do not disclose a new board game. The inventive device includes a game board having plurality of discrete paths thereon and defining a quadrant. Each of the game paths is divided into a plurality of game spaces and each game path ends at an inner circle position in a central portion of the game board. Each of the game spaces is colored a color selected from the group consisting of green, orange, blue, red, yellow, brown and white. Each of a plurality of overlays is positionable on one of the game paths. Each of the overlays generally has the shape of one of the game paths such that each of the overlays may be positioned over one of the quadrants. Each of the overlays is substantially transparent. Each of the overlays has a plurality of symbols thereon. A first die is a six sided die, wherein each of the sides has a different indicia thereon indicating a number 1 through 6. A second die is a six sided die, wherein each of the sides has a different color indicia thereon indicating green, orange, blue, red, yellow or brown. A third die is a six sided die, wherein each of the sides of the third die has a different symbol indicia thereon indicating one of the symbols on the overlays.

In these respects, the board game according to the present invention substantially departs from the conventional concepts and designs of the prior art, and in so doing provides an apparatus primarily developed for the purpose of providing entertainment and teaching strategy.

SUMMARY OF THE INVENTION

In view of the foregoing disadvantages inherent in the known types of board games now present in the prior art, the present invention provides a new board game construction wherein the same can be utilized for providing entertainment and teaching strategy.

The general purpose of the present invention, which will be described subsequently in greater detail, is to provide a new board game apparatus and method which has many of the advantages of the board games mentioned heretofore and many novel features that result in a new board game which is not anticipated, rendered obvious, suggested, or even implied by any of the prior art board games, either alone or in any combination thereof.

To attain this, the present invention generally comprises a game board having plurality of discrete paths thereon and defining a quadrant. Each of the game paths is divided into a plurality of game spaces and each game path ends at an inner circle position in a central portion of the game board. Each of the game spaces is colored a color selected from the group consisting of green, orange, blue, red, yellow, brown and white. Each of a plurality of overlays is positionable on one of the game paths. Each of the overlays generally has the shape of one of the game paths such that each of the overlays may be positioned over one of the quadrants. Each of the overlays is substantially transparent. Each of the overlays has a plurality of symbols thereon. A first die is a six sided die, wherein each of the sides has a different indicia thereon indicating a number 1 through 6. A second die is a six sided die, wherein each of the sides has a different color indicia thereon indicating green, orange, blue, red, yellow or brown. A third die is a six sided die, wherein each of the sides of the third die has a different symbol indicia thereon indicating one of the symbols on the overlays.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new board game apparatus and method which has many of the advantages of the board games mentioned heretofore and many novel features that result in a new board game which is not anticipated, rendered obvious, suggested, or even implied by any of the prior art board games, either alone or in any combination thereof.

It is another object of the present invention to provide a new board game which may be easily and efficiently manufactured and marketed.

It is a further object of the present invention to provide a new board game which is of a durable and reliable construction.

An even further object of the present invention is to provide a new board game which is susceptible of a low cost of manufacture with regard to both materials and labor, and which accordingly is then susceptible of low prices of sale to the consuming public, thereby making such board game economically available to the buying public.

Still yet another object of the present invention is to provide a new board game which provides in the apparatuses and methods of the prior art some of the advantages thereof, while simultaneously overcoming some of the disadvantages normally associated therewith.

Still another object of the present invention is to provide a new board game for providing entertainment and teaching strategy.

Yet another object of the present invention is to provide a new board game which includes a game board having plurality of discrete paths thereon and defining a quadrant. Each of the game paths is divided into a plurality of game spaces and each game path ends at an inner circle position in a central portion of the game board. Each of the game spaces is colored a color selected from the group consisting of green, orange, blue, red, yellow, brown and white. Each of a plurality of overlays is positionable on one of the game paths. Each of the overlays generally has the shape of one of the game paths such that each of the overlays may be positioned over one of the quadrants. Each of the overlays is substantially transparent. Each of the overlays has a plurality of symbols thereon. A first die is a six sided die, wherein each of the sides has a different indicia thereon indicating a number 1 through 6. A second die is a six sided die, wherein each of the sides has a different color indicia thereon indicating green, orange, blue, red, yellow or brown. A third die is a six sided die, wherein each of the sides of the third die has a different symbol indicia thereon indicating one of the symbols on the overlays.

Still yet another object of the present invention is to provide a new board game that includes overlays which may be turned upside down and placed on a quadrant for varying the game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
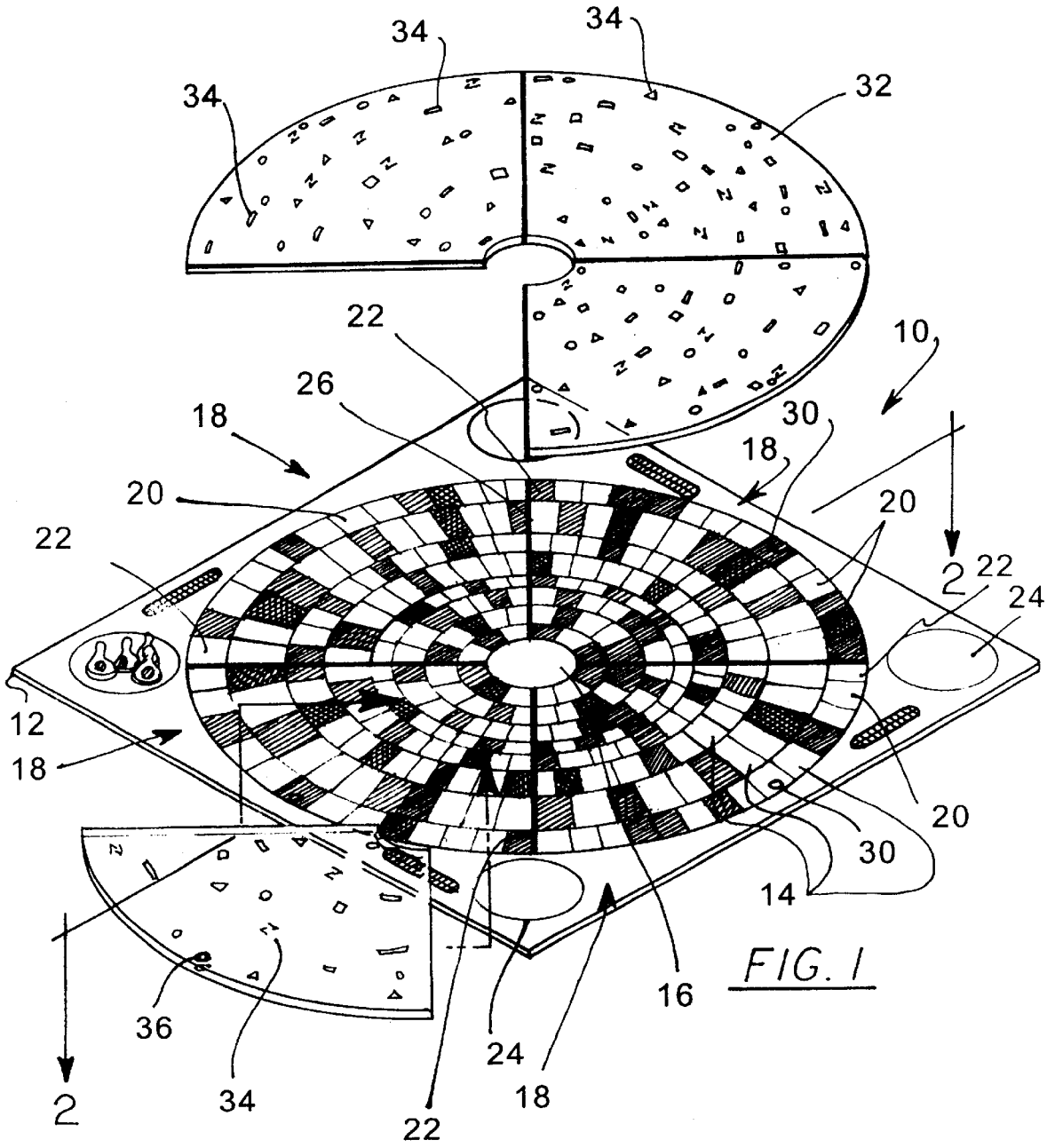
FIG. 1 is a schematic perspective view of a new board game according to the present invention.
Figure 2:
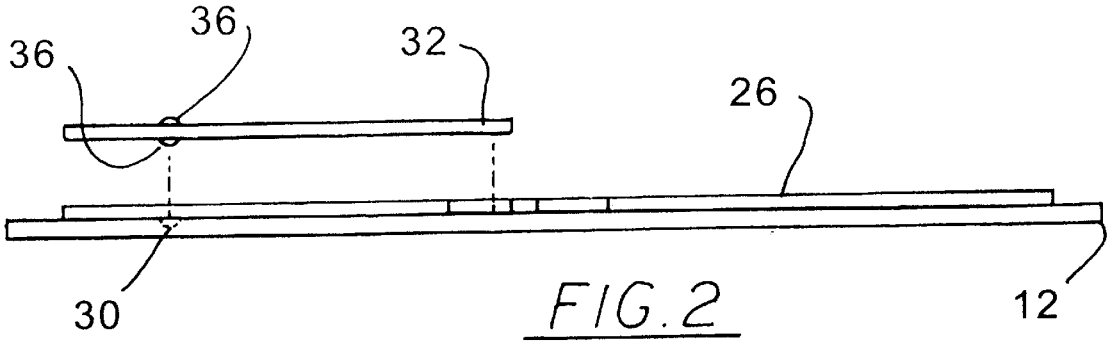
FIG. 2 is a schematic cross-sectional view taken along line 2—2 of the present invention.
Figure 3:
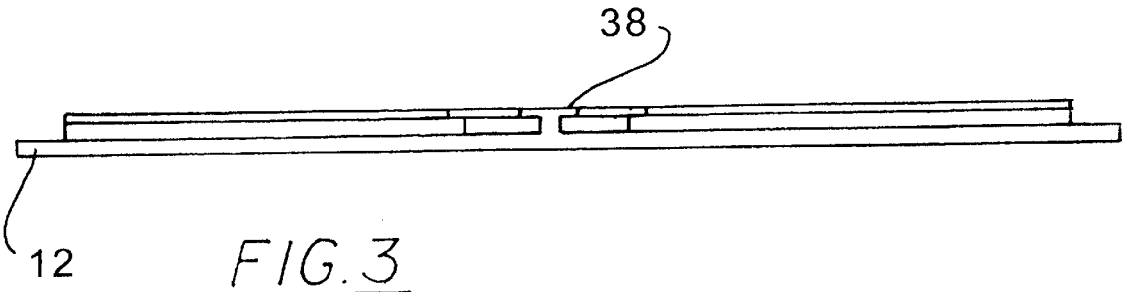
FIG. 3 is a schematic cross-sectional view of a second embodiment of the present invention.
Figure 5:
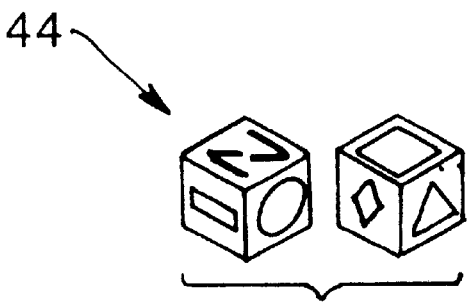
FIG. 5 is a schematic perspective view of the second die of the present invention.
Figure 4:
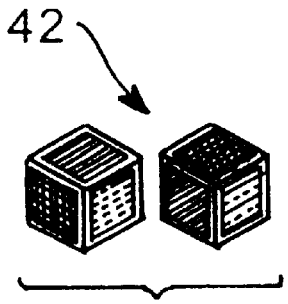
FIG. 4 is a schematic perspective view of the third die of the present invention.
Figure 7:
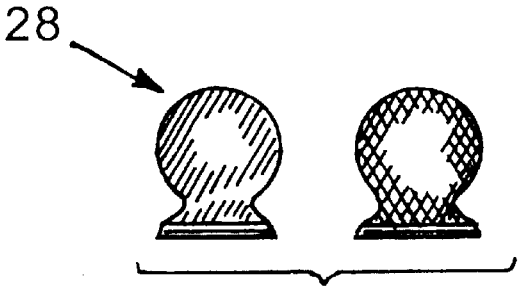
FIG. 7 is a schematic side view of the game pieces of the present invention.
Figure 6:
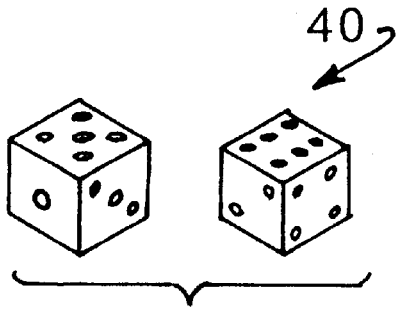
FIG. 6 is a schematic perspective view of the first die of the present invention.

With reference now to the drawings, and in particular to FIGS. 1 through 7 thereof, a new board game embodying the principles and concepts of the present invention and generally designated by the reference numeral 10 will be described.

As best illustrated in FIGS. 1 through 7, the board game 10 generally includes a game board 12 having a plurality of concentric and adjacently positioned annular bands 14 thereon such that an inner circle 16 encompassed by the bands 14 is defined. A pair of lines orientated perpendicular to each other and extending through the inner circle divides each of the annular bands into four quadrants 18. Each of the quadrants 18 contains a plurality of arcuate portions defined by sections of the annular bands. Each of the arcuate portions is divided into game spaces 20. Each of the game spaces 20 is colored a color selected from the group consisting of green, orange, blue, red, yellow, brown and white. An outer-most arcuate portion of each of the quadrants has a starting space 22 positioned on a right edge of the respective quadrant 18. The quadrants 18 each defines a game path beginning at a respective starting space 22 and ending at the inner circle 16 such that a player moves along each adjacent game space 20 in an arcuate portion and then to the next adjacent arcuate portion towards the inner circle 16. Each of a plurality of base areas 24 is positioned on the game board 12. Each of the base areas 24 is positioned adjacent to one of the starting spaces 22. Each of four barriers 26 is integrally coupled to the game board 12 and extends along a dividing line between a pair of adjacent quadrants 18. The outer arcuate portions each have a depression 30 therein.

Each of a plurality of sets of a game pieces 28 contains four game pieces. Each of the sets is colored a different color.

Each of a plurality of overlays 32 is provided for positioning on the game board 12. Each of the overlays 32 generally has the shape of one of the quadrants 18 such that each of the overlays 32 may be positioned over one of the quadrants 18. The overlays 32 are substantially transparent and each has a plurality of symbols 34 randomly positioned thereon such that each overlay is different. Each of the symbols 34 is selected from the group consisting of a circle, a square, a dash, a diamond, a triangle, and a letter Z. Each of the symbols 34 is positioned such that each of the symbols is located in one of the game spaces 20 when each of the overlays 32 is positioned on one of the quadrants 18. The overlays 32 each have a top surface and a bottom surface. A nub 36 is positioned on each of the top and bottom surfaces. Each of the nubs 36 is located such that each of the nubs 36 may be positioned in one of the depressions 30 in the game board 12 when the overlay 32 is positioned on a quadrant 18. The plurality of overlays 32 is preferably four overlays, though multiple overlays may be used for varying the game. The nubs 36 and barriers 26 help to keep the overlays 32 in position on the quadrant 18. Alternatively, a raised disc 38 may be positioned in the central area for placing and edge of an overlay 32 under.

A chance means is used for moving the game pieces about the game board. The chance means includes a first die 40, a second die 42 and third die 44. The first die 40 is a conventional six sided die. Each of the sides of the first die 40 has a different indicia thereon indicating a number 1 through 6. The second die 42 is a six sided die. Each of the sides of the second die 42 has a different color indicia thereon indicating green, orange, blue, red, yellow or brown. The third die 44 is also a six sided die. Each of the sides of the third die 44 has a different symbol indicia thereon indicating a circle, a square, a dash, triangle, diamond, or a letter Z.

Rules of the Game

Each of the players selects a quadrant 18, an overlay 32 for positioning on the players' selected quadrant 18, and a set of game pieces 28 and positioning the game pieces 28 in the base area 24 adjacent to the players' quadrant 18.

The players each concurrently roll the first 40, second 42, and third 44 die in turn such that a first of the players rolls the dice followed by a second of the players in a clockwise order.

A game piece 28 is moved by a dice rolling player from the base area to the starting space 22 if the first die 40 indicates a one or a six. The dice rolling player may move one of the game pieces 28 a number of game spaces 20 indicated by the number indicia on the first die 40 if the game piece 28 being moved is positioned on the game path. The game piece 28 may be positioned in the inner circle 16 if the number indicated is greater than the number of game spaces 20 remaining between the game piece 28 and the inner circle 16.

The dice rolling player moves one of their game pieces 28 on a particular one of the symbols 34 to the next occurrence of the same particular symbol 34 if the third die 44 indicates the particular symbol on which the dice rolling player's game piece 28 to be moved is positioned. The game piece 28 may be positioned in the inner circle 16 if no occurrences of the particular symbol remain between the game piece 28 and the inner circle 16. The player must first move a game piece according the number indicated on the first die 40 before utilizing the third die 44.

A dice rolling player selects another player's game piece 28 and moves the selected game piece to its base area 24 if the second die 42 rolled by the dice rolling player indicates a color on which the other player's game piece 28 is positioned. The dice rolling player may choose any of the other player's game pieces 28.

The player who first positions all of their game pieces 28 in the inner circle 16 wins the game.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a board game comprising the steps of:

providing a game board having plurality of discrete paths thereon and defining a quadrant, each of said game paths being divided into a plurality of game spaces, each of said game paths ending at an inner circle position in a central portion of said game board, each of said game spaces being colored a color selected from the group consisting of green, orange, blue, red, yellow, brown and white;

providing a plurality of sets of a game pieces;

providing a plurality of overlays for positioning on one of said game paths, each of said overlays generally having the shape of one of said game paths such that each of said overlays may be positioned over one of said quadrants, each of said overlays being substantially transparent, each of said overlays having a plurality of symbols thereon;

providing a chance means for moving said game pieces about said game board, said chance means comprising;

a first die, said first die being a six sided die, each of said sides of said first die having a different indicia thereon indicating a number 1 through 6;

a second die, said second die being a six sided die, each of said sides of said second die having a different color indicia thereon indicating green, orange, blue, red, yellow or brown;

a third die, said third die being a six sided die, each of said sides of said third die having a different symbol indicia thereon indicating one of said symbols on said overlays;

providing a plurality of players;

selecting a quadrant by each of said players;

selecting an overlay by each of said players and positioning of said overlay on said players' selected quadrant;

selecting a set of game pieces by each of said players;

concurrently rolling the first, second, and third die by each of said players in turn;

moving one of said game pieces by said dice rolling player a number of game spaces indicated by the number indicia on said first die;

moving one of said game pieces positioned on a particular one of the symbols to the next occurrence of the same particular symbol if the third die indicates said particular symbol on which said dice rolling player's game piece to be moved is positioned;

selecting another player's game piece by said dice rolling player and moving the selected game piece to its base area if the second die rolled by the dice rolling player indicates a color on which the other player's game piece is positioned; and winning the game by the first player to position all of their game pieces in said center circle.

2. The method of playing a board game as in claim 1, wherein the step of providing a game board includes a plurality of concentric and adjacently positioned annular bands thereon such that the inner circle is encompassed by said bands, each of said annular bands being divided into said quadrants by a pair of lines orientated perpendicular to each other and extending through said inner circle, each of said quadrants contains a plurality of arcuate portions defined by sections of said annular bands, each of said arcuate portions being divided into said game spaces, an outer-most arcuate portion of each of said quadrants having a starting space positioned on a right edge of the respective quadrant, each of said quadrants defining one of said game paths beginning at a respective starting space and ending at said inner circle such that a player moves along each adjacent game space in an arcuate portion and then to the next adjacent arcuate portion towards said inner circle.

3. The method of playing a board game as in claim 2, wherein the step of providing a game board further includes:

each of a plurality of base areas being positioned on said game board, each of said base areas being positioned adjacent to one of said starting spaces; and moving one of said game pieces by a dice rolling player from said base area to said starting space if the first die indicates a one or six.

4. The method of playing a board game as in claim 1, wherein the step of providing a plurality of overlays includes each of said overlays having a plurality of symbols thereon selected from the group consisting of a circle, a square, a dash, a diamond, a triangle, and a letter Z.

5. A method of playing a board game comprising the steps of:

providing a game board, said game board having a plurality of concentric and adjacently positioned annular bands thereon such that an inner circle encompassed by said bands is defined, each of said annular bands being divided into four quadrants by a pair of lines orientated perpendicular to each other and extending through said inner circle, each of said quadrants contains a plurality of arcuate portions defined by sections of said annular bands, each of said arcuate portions being divided into game spaces, each of said game spaces being colored a color selected from the group consisting of green, orange, blue, red, yellow, brown and white, an outer-most arcuate portion of each of said quadrants having a starting space positioned on a right edge of the respective quadrant, wherein each of said quadrants defines a game path beginning at a respective starting space and ending at said inner circle such that a player moves along each adjacent game space in an arcuate portion and then to the next adjacent arcuate portion towards said inner circle, each of a plurality of base areas being positioned on said game board, each of said base areas being positioned adjacent to one of said starting spaces, each of four barriers being integrally coupled to said game board and extending along a dividing line between a pair of adjacent quadrants, each of said outer arcuate portions having a depression therein;

providing a plurality of sets of a game pieces, each of said sets containing four game pieces, each of said sets being colored a different color;

providing a plurality of overlays for positioning on said game board, each of said overlays generally having the shape of one of said quadrants such that each of said overlays may be positioned over one of said quadrants, each of said overlays being substantially transparent, each of said overlays having a plurality of symbols thereon selected from the group consisting of a circle, a square, a dash, a diamond, a triangle, and a letter Z, each of said symbols being positioned such that each of said symbols is located in one of said game spaces when each of said overlays is positioned on one of said quadrants, each of said overlays having a top surface and a bottom surface, each of said top and bottom surfaces having a nub thereon, each of said nubs being located such that each of said nubs may be positioned in one of said depressions in said game board when said overlay is positioned on a quadrant, said plurality of overlays being four overlays;

providing a chance means for moving said game pieces about said game board, said chance means comprising;

a first die, said first die being a six sided die, each of said sides of said first die having a different indicia thereon indicating a number 1 through 6;

a second die, said second die being a six sided die, each of said sides of said second die having a different color indicia thereon indicating green, orange, blue, red, yellow or brown;

a third die, said third die being a six sided die, each of said sides of said third die having a different symbol indicia thereon indicating a circle, a square, a dash, triangle, diamond, or a letter Z;

providing a plurality of players;

selecting a quadrant by each of said players;

selecting an overlay by each of said players and positioning of said overlay on said players' selected quadrant;

selecting a set of game pieces by each of said players and positioning said game pieces in the base area adjacent to said players' quadrant;

concurrently rolling the first, second, and third die by each of said players in turn such that a first of said players rolls said dice followed by a second of said players in a clockwise order;

moving one of said game pieces by a dice rolling player from said base area to said starting space if the first die indicates a one or a six or moving one of said game pieces by said dice rolling player a number of game spaces indicated by the number indicia on said first die if said game piece being moved is positioned on said game path, said game piece may be positioned in said inner circle if the number indicated is greater than the number of game spaces remaining between said game piece and said inner circle;

moving one of said game pieces positioned on a particular one of the symbols to the next occurrence of the same particular symbol by said dice rolling player after said dice rolling player moves one of said game pieces according to the first die if the third die indicates said particular symbol on which said dice rolling player's game piece to be moved is positioned, said game piece may be positioned in said inner circle if no occurrences of said particular symbol remain between said game piece and said inner circle;

selecting another player's game piece by said dice rolling player and moving the selected game piece to its base area if the second die rolled by the dice rolling player indicates a color on which the other player's game piece is positioned; and winning the game by the first player to position all of their game pieces in said center circle.

6. A board game comprising:

a game board having plurality of discrete paths thereon and defining a quadrant, each of said game paths being divided into a plurality of game spaces, each of said game spaces ending at an inner circle position in a central portion of said game board, each of said game spaces being colored a color selected from the group consisting of green, orange, blue, red, yellow, brown and white;

a plurality of sets of a game pieces;

a plurality of overlays for positioning on one of said game paths, each of said overlays generally having the shape of one of said game paths such that each of said overlays may be positioned over one of said quadrants, each of said overlays being substantially transparent, each of said overlays having a plurality of symbols;

a chance means for moving said game pieces about said game board, said chance means comprising;

a first die, said first die being a six sided die, each of said sides of said first die having a different indicia thereon indicating a number 1 through 6;

a second die, said second die being a six sided die, each of said sides of said second die having a different color indicia thereon indicating green, orange, blue, red, yellow or brown;

a third die, said third die being a six sided die, each of said sides of said third die having a different symbol indicia thereon indicating one of said symbols on said overlays.

* * * * *